United States Patent [19]

Hoo

[11] 4,154,353

[45] May 15, 1979

[54] SAFETY CONTAINER

[76] Inventor: William K. C. Hoo, 3 Sherwood Dr., Bedford, Mass. 01730

[21] Appl. No.: 930,905

[22] Filed: Aug. 4, 1978

[51] Int. Cl.[2] ..... B65D 55/02; B65D 85/56; A61J 1/00

[52] U.S. Cl. ..... 215/209; 215/206; 215/216; 215/223; 215/224

[58] Field of Search ..... 215/206, 209, 216, 223, 215/224, 225

[56] References Cited

U.S. PATENT DOCUMENTS

| | | | |
|---|---|---|---|
| 3,902,620 | 9/1975 | McIntosh | 215/209 |
| 4,043,475 | 8/1977 | Wheeler | 215/223 |
| 4,087,016 | 5/1978 | Towns et al. | 215/206 X |

*Primary Examiner*—George T. Hall
*Attorney, Agent, or Firm*—Thompson, Birch, Gauthier & Samuels

[57] ABSTRACT

An improved safety container for pills and the like is in the form of a jar with an elastically deformable cylindrical cap of the snap-on and -off type. Mating flanges are provided on the jar and the inside of the cap which, when engaged, captively hold the cap to the jar yet permit the cap to rotate. Special tapers are provided on the mating flanges which act cooperatively under the influence of the elastic restoring forces of the cap to force the top of the cap into tight sealing contact with the lip of the mouth of the jar. This seal is further improved by the provision of mating beveled features on the interior of the top of the cap and the lip of the jar.

A tab is provided on the cap to permit the user to apply the necessary force to deform the cap in order to remove it. A locking feature is provided by a keyway cut in this tab designed to engage and ride captively on a locking flange which encircles all but a small portion of the jar. Only in the unique orientation of the tab where an interruption in the locking flange is registered with the tab, is the tab free to move upward, levering off the cap. A safety mechanism is provided in the form of an elastically deformable safety catch affixed to the jar and designed to overhang the tab when it is in the unique orientation.

10 Claims, 15 Drawing Figures

SAFETY CONTAINER

The present invention relates to an improved safety container, typically for medicaments and the like, which features a sealable snap-on and -off cap.

Safety containers are in common use for the packaging of consumer products and prescription drugs in the form of tablets, powders, and liquids, which products and drugs may be potentially hazardous if accessable to persons, such as children, unable to comprehend the nature of the drug. Such containers generally are provided with a locking closure which is intended to be openable only upon the performance of a sequence of operations, not obvious to the uninitiated, printed upon the container or otherwise made available to those for whom access is intended.

A typical example of such a container, such as is shown in U.S. Pat. No. 3,393,816, has an elastically deformable cap which fits over and around the opening in the container and is designed to be held closing the container by a pair of meshing flanges on the interior of the cap and the exterior of the container. The cap is intended to be removable only by applying an upward force to a tab affixed to the cap, thereby elastically deforming the cap, permitting the meshing flanges to disengage, and thus freeing the cap. The container is closed by pressing the cap down on the container, elastically deforming the cap thereby allowing the meshing flanges to override one another, after which the cap elastically relaxes, engaging the flanges and securing the cap to the container. When the container is closed, the cap is free to rotate, and the safety feature is provided by a broad flange on the container which covers the lower surface of the tab in all but one position of the cap, thereby preventing the normal opening action.

One disadvantage of containers of this type is that the safety feature is not automatic: closing the container does not necessarily secure the tab in the safety position. Experience has further shown that such containers, even if properly secured, can nevertheless be accidentally opened through the inadvertent re-alignment of the tab to the snap-off position, or by a prying action with a sharp object, such as a fingernail, even when the tab is in the safety position. This last problem appears in part to be due to the necessary manufacturing tolerances and in part to be due to wear on the flanges providing the closing action. These factors also contribute to another disadvantage of this type of container; namely, such containers are found to imperfectly seal against moisture and other atmospheric contaminants, thereby inadequately protecting their contents against degradation in some instances.

Accordingly, an object of the present invention is to provide a safety container having a snap-on and -off closure which automatically secures itself in a safety condition when closed.

A further object of the present invention is to provide a safety container which is relatively more secure than prior art devices against accidental opening due to inadvertent alignment of cap and container.

Another object of the present invention is to provide a safety container with a snap-on and -off closure which is less susceptible to being opened, when in the safety condition, by a prying action applied by a sharp edge inserted between cap and container.

A further object of the present invention is to provide a safety container with a snap-on and -off cap which provides a seal against moisture and other atmospheric contaminants.

Yet another object of the present invention is to provide a design for such a safety container wherein the action of the mating flanges providing the seal is relatively insensitive to the effects of manufacturing tolerances and wear.

These and other objects are met by the present invention of which a preferred embodiment is a safety container for pills, liquids and the like in the form of a jar with an elastically deformable cylindrical cap. Mating annular flanges are provided on the jar and on the inside of the cap which, when engaged, hold the cap on the jar, yet permit it to rotate. Special tapers or bevels are provided on the mating flanges which act cooperatively under the influence of the elastic restoring forces of the cap to force the top of the cap into tight sealing contact with the lip of the mouth of the jar. This seal is further improved by the provision of mating beveled features on the interior of the top of the cap and on the lip of the jar.

A tab is provided on the cap to permit the user to apply the necessary force to deform the cap in order to remove it. This tab extends not only outwardly from the cap, but also downwardly from the lower edge of the cap. A keyway cut in the lower portion of the tab is designed to engage and ride captively on the locking flange which encircles all but a small portion of the jar. Only in the unique orientation where the tab is registered with an interruption in the locking flange, is the tab free to move upward permitting the cap to be levered off of the jar. An elastically deformable safety catch may be affixed to the jar and designed to overhang the tab, arresting its upward motion, even when the tab is in this unique orientation with respect to the flange.

In operation, the closed and locked container can only be opened by rotating the cap to the sole position wherein the tab can be disengaged from the locking flange, and then depressing a trigger on the safety catch, so as to flex the safety catch out of engagement with the tab, while simultaneously forcing up the tab, elastically distorting the cap so that the meshing flanges override one another. To close the container, the cap is brought over the mouth of the jar with the tab aligned with the opening in the locking flange, and the safety catch is pushed or pulled aside while the cap is forced down. The cap elastically distorts so that the meshing flanges are forced past one another, whereupon external force may be removed. The elastic restoring forces in the cap act through the flanges to secure the cap to the jar and effect a seal; the elastic restoring forces in the safety catch causes the safety catch to override the tab, securing the tab from accidental activation. A rotation of the cap then engages the tab to the locking flange, further securing the container.

It will be noted that the safety container described herein when closed, automatically secures itself in a safety condition through the action of the safety catch, and that the safety catch also provides security against accidental opening when the tab is inadvertently aligned to the unlocked position. The safety container of the present invention is thus relatively more secure against accidental opening arising either from failure to operate fully its security features of from inadvertent inactivation of the single security feature characteristic of prior art containers.

In the fully secured condition, the safety container described herein positively engages the tab, rather than merely restricting access to its lower surface, as do prior art containers. The present invention thereby provides significant protection against the fully secured container being opened by the prying action of a sharp edge.

Unlike prior art containers, wherein the elastically deformable cap is merely held captive by the meshing flanges, and is in an elastically relaxed state after closure, the cap of the container described herein is held closed under tension by the elastic restoring forces of the cap acting through bevels on the meshing flanges. This feature, together with the bevels provided on the interior top of the cap and the lip of the container, produces a tighter seal and also prevents looseness due to manufacturing tolerances and wear.

Other objects of the present invention will in part appear obvious and will in part appear hereinafter. The invention accordingly comprises the apparatus possessing the construction, combination of elements, and arrangement of parts which are exemplified in the following detailed disclosure and the scope of the applications of which will be indicated in the claims.

For a fuller understanding of the nature and objects of the present invention, reference should be had to the following detailed description taken in connection with the accompanying drawings wherein.

Figure 1:
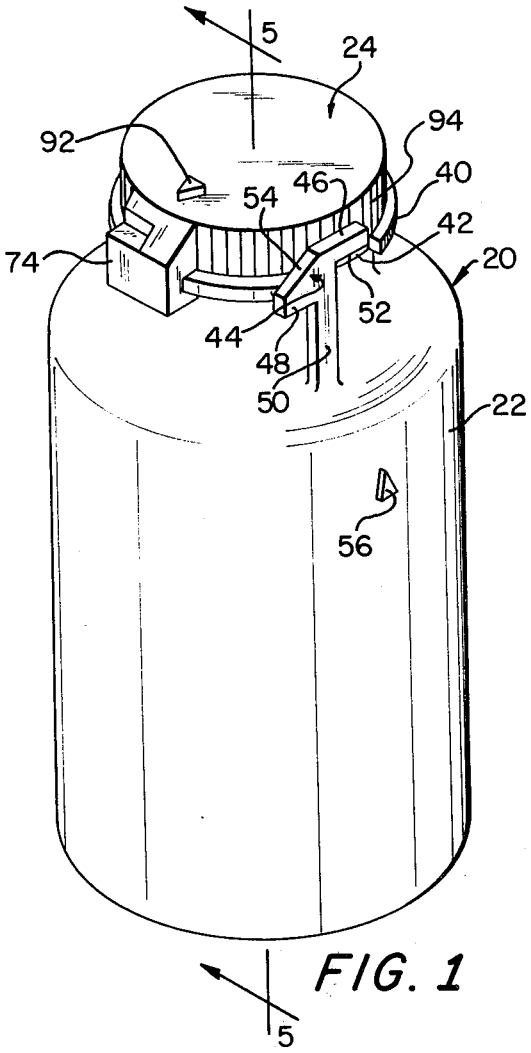
FIG. 1 is a perspective view of a container embodying the present invention with the cap fully closed, locked, and sealed.

Referring to FIG. 1, it may be seen that container 20, made in accordance with the present invention, includes container body 22 and cap 24. Container body 22 typically is a relatively thin walled hollow body, and, as may be seen in FIG. 4, access to its interior is had through a single opening or mouth 26, normally closed by cap 24. In a preferred embodiment, container body 22 is in the form of jar on the order of 55 mm in outside diameter and 90 mm in height, cap 24 typically on the order of 45 mm in outside diameter and 5 mm in height. These diameters are preferred as minima since it has been found that a child less than about five years of age has difficulty handling objects of this size, and consequently these dimensions enhance the safety features of the present invention. It should be noted, however, that the present invention does not depend upon this fact, and these dimensions as well as the overall shape of the container are provided for illustrative purposes only. The thickness of the walls of container 20 necessarily depends upon the material of construction, and may be determined by means well known in the art. Container 20 is preferably fabricated, by methods well known in the art, of a resilient polymeric material, such as polyethelene and the like.

Mouth 26 is substantially circular in cross-section. As may be seen in FIG. 4 it is formed at one end of a thin-walled cylindrical section or neck 28 of container body or jar 22. The interior and exterior surfaces of the walls comprising cylindrical section 28 are in the form of substantially smooth concentric right cylinders.

For purposes of reference hereinafter, it will be convenient to establish a convention for directions with respect to the cylinders defining the wall surfaces of cylindrical section 28. With regard to the normally closed container, as illustrated in FIG. 1, "inward", as used hereinafter shall mean in a direction toward the axes of the hereinabove mentioned concentric cylinders and "outward" shall mean in a direction away from these axes. "Upward" and "downward" shall mean the directions parallel to the axes of these cylinders, "upward" being in the direction from the interior of container 20 to the exterior, through mouth 26, and "downward" being the opposite direction. These directions are consistent with the figures as drawn.

Figure 4:
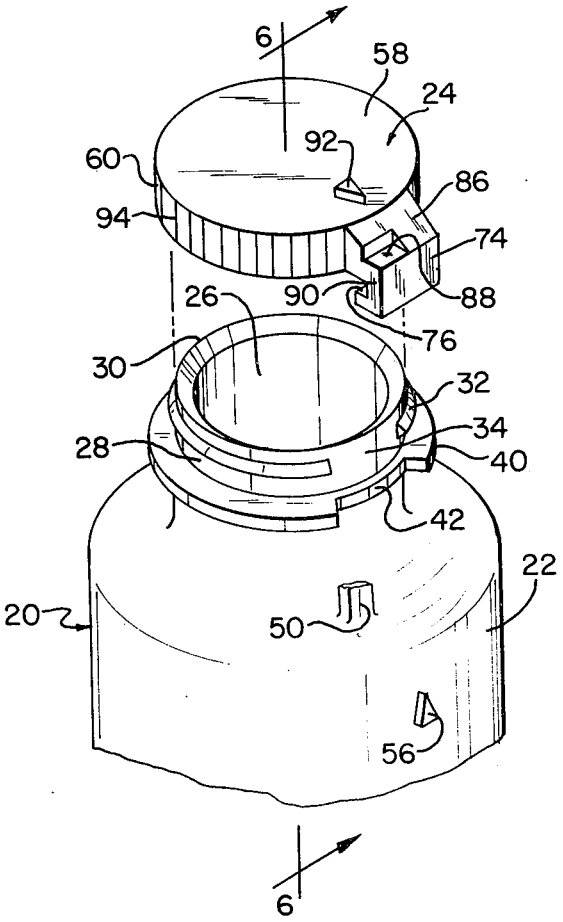
FIG. 4 is an exploded view as in FIG. 2, with the safety means broken away, to show details of the construction of the body of the container.

The downward end of neck 28 blends into container body 22, as may be seen in FIG. 4. At the upward end of neck 28, the walls comprising the section terminate, forming circular mouth 26. Mouth 26 lies in a plane normal to the axes of the cylinders defining cylindrical section 28. In a preferred embodiment mouth 26 if formed inside by lip 30 in the form of a knife-edge beveled downward and inward at an angle on the order of 45 degrees; this bevel in effect is a substantially smooth truncated cone concentric with neck 28 and having an apex in the direction downward from mouth 26.

Figure 6:
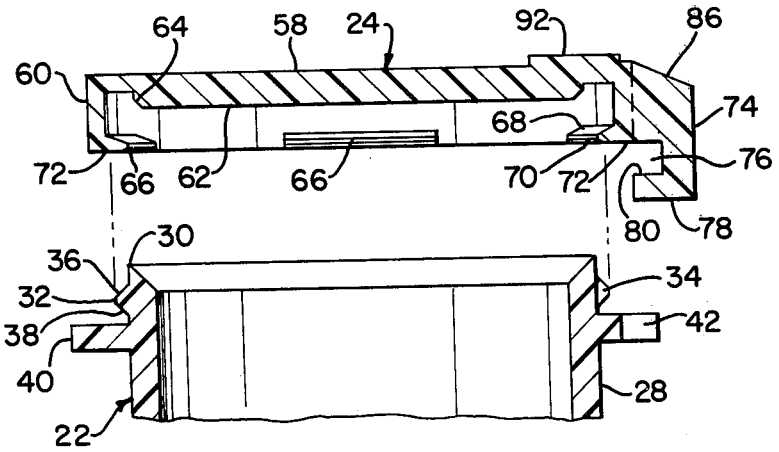
FIG. 6 is a fragmentary sectional view of the opened container, taken along the lines 6—6 of FIG. 4.

Below mouth 26, affixed to the exterior surface of cylindrical section 28 is catch flange 32. As may be seen in FIGS. 4 and 8, catch flange 32 is in the form of a thin ring or annulus adding a small radius (e.g., on the order of 1 mm) to cylindrical section 28 along all but a small circumferential region such as opening 34. In section, catch flange 32 is doubly i.e., oppositely beveled, having an upper surface 36, shown in FIG. 6, beveled downwardly and outwardly from cylindrical section 28 at a relatively steep angle (i.e., about 70° downward) to a normal to the surface of cylindrical section 28. Upper surface 36 in effect is a substantially smooth truncated cone concentric with cylindrical section 28 and having an apex which extends an angle of about 40° located in an upward direction from flange 32. Lower surface 38 of catch flange 32, also seen in FIG. 6, is beveled upwardly and outwardly from cylindrical section 28 at a relatively shallow angle downward from the normal to cylindrical section 28 (e.g., about 30°). Lower surface 38 is in effect a relatively smooth truncated cone concentric with cylindrical section 28 and having an apex, which subtends an angle of about 120°, located in a downward direction from flange 32.

Figure 8:
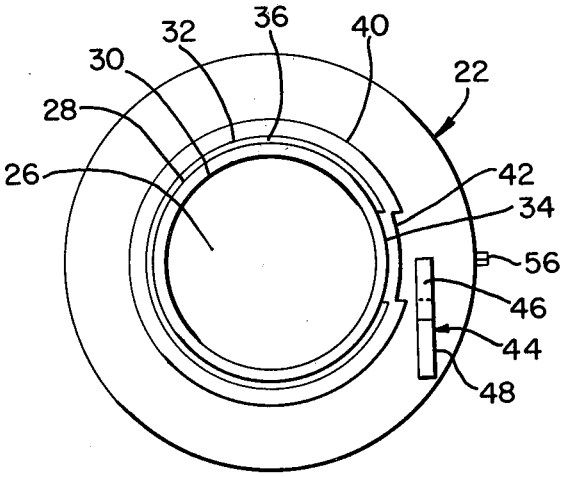
FIG.8 is a plan view of the top of the opened container.

Located below and spaced from catch flange 32 is locking flange 40, also affixed to the exterior of cylindrical section 28. The distance between catch flange 32 and locking flange 40 is chosen to accommodate a latching flange on cap 24, described hereinafter. Referring to FIGS. 4 and 8, it may be seen that locking flange 40 is in the form of a ring or annulus about cylindrical section 28 extending further radially outward than catch flange 32, adding a radius of about 4 mm along all but a small circumferential region such as discontinuity or opening 42. At opening 42, locking flange 40 adds only about 2 mm to the radius of cylindrical section 28. Opening 42 in locking flange 40 and opening 34 in catch flange 32 are aligned or registered with one another in an upward direction. As may be seen in FIG. 6, locking flange 40 typically has a rectangular section and is a substantially smooth, flat disk normal to cylindrical section 28.

The exterior surface of neck 28 is maintained clear for at least a short distance below flange 40 to accommodate the structure of tab 74 as described hereinafter.

Referring to FIG. 1, there may be seen safety stop 44 affixed to container body 22. Safety stop 44 is formed of catch 46, trigger 48, and flexible member or mounting post 50. Stop 44 is attached to container body 22 through elongated cantilever beam or post 50, the latter rising upwardly from its point of attachment on container body 22 (i.e., normal to the plane of rotation of cap 24) and so disposed as to be radially aligned with, and slightly outward from, opening 42 in locking flange 40. The distance between post 50 and neck 28 is chosen so as to provide clearance between safety stop 44 and locking flange 40. The cross sectional dimensions of post 50 are chosen, depending upon the elasticity of the material of construction, to allow for flexure of safety stop 44 as will also be described hereinafter.

Catch 46 is affixed to the upper end of post 50, so as to overhang opening 42. Catch 46 is in the form of a neck having a planar lower face 52 which lies in a plane normal to the long axis of post 50 and has a dimension (normal to the axis of post 50) which is a moderate (e.g., between about 10% and 50%) percentage of the circumferential dimension of opening 42. The height of post 50 is chosen such that lower face 52 also lies substantially in the plane of lip 30.

Trigger portion 48 is affixed to post 50 adjacent catch 46, and extends some 10 mm in a direction normal to the long axis of post 50. Upper surface 54, of trigger 48, is beveled downwardly and preferably has a legend such as "PRESS" embossed upon it.

A fiducial mark 56, in the form of an arrow, is affixed to container body 22 below and in alignment with, the center of opening 42 to indicate the circumferential position of the latter.

Referring to FIGS. 4 and 6, there may be seen cap 24, which is basically in the form of a short, hollow right cylinder, closed at one end by a substantially flat circular solid top 58, and having a cylindrical side wall or depending skirt 60. The inside diameter of cap 24 is chosen to provide, when container 20 is assembled, a loose clearance about catch flange 32. As will be described hereinafter, cap 24 is designed to undergo an elastic deformation during operation, and consequently is relatively thin walled, e.g., on the order of 1 mm thickness, depending on the material of construction. The outside diameter of cap 24 is preferably equal to or slightly less than that of locking flange 40.

Figure 7:
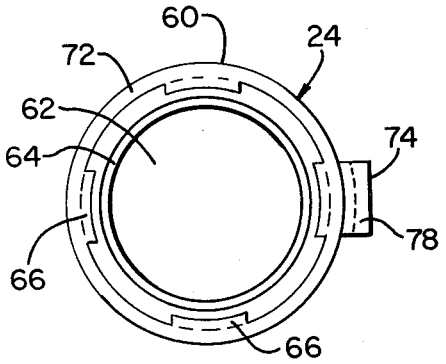
FIG. 7 is a plan view of the interior of the cap of the container.

Disposed centrally on the underneath surface of top 58 is a raised plateau or disk 62, best seen in FIGS. 6 and 7. Disk 62 is slightly smaller in diameter than lip 30, and its edge 64 is a downwardly and inwardly tapered. Edge 64 is thus a smooth truncated cone concentric with cylindrical side walls 60 and having an apex which subtends an angle of about 90° located downwardly from top 58. Edge 64 is so dimensioned and disposed as to provide a sealing interference fit with the beveled edge of lip 30 when the container is in the sealed condition shown in FIG. 5. It should be noted that tapered surface 64 and the bevel of lip 30 are provided at similar or matching angles.

Affixed to the interior of cylindrical side wall 60 is latch flange 66, in the form of a thin segmented ring which extends inwardly (e.g., by about 1 mm) radially from cylindrical side wall 60, as may be seen by reference to FIGS. 6 and 7. The radial dimension of latch flange 66 is chosen so as to provide a loose clearance around cylindrical section 28 when container 20 is assembled. Latch flange 66 is provided with upper surface 68 and lower surface 70, both beveled, as seen in FIG. 6. Upper surface 68 is beveled inwardly and downwardly at a shallow angle to the normal to cylindrical side wall 60, (e.g., about 30°). Upper surface is in effect a substantially smooth segmented truncated cone concentric with cylindrical side wall 60 and having an apex extending downwardly from latch flange 66, and subtending an angle of some 120°. Upper surface 68 of latch flange 66 and lower surface 38 of catch flange 32 are provided with similarly angled bevels, and these bevels are at a relatively shallower downward angle than the bevels on edge 64 and lip 30. Lower surface 70 is beveled inwardly and upwardly at a relatively steep angle (e.g. about 70°) to the normal to cylindrical side wall 60. Lower surface 70 is thus a substantially smooth segmented truncated cone having an apex extending upwardly from latch flange 66, and subtending an angle of about 40°. Lower surface 70 of latch flange 66 and upper surface 36 of catch flange 32 are provided with similarly angled bevels. For reasons which will be described hereinafter, the distance between the periphery of the interior of top 58 and latch flange 66 is chosen to be slightly less than the distance from the upper edge of lip 30 to catch flange 32.

The lower edge 72 of skirt 60, seen best in FIG. 6, is substantially flat and lies roughly in a plane normal to the axis of cylindrical side wall 60. The distance between the periphery of the interior of top 58 and lower edge 72 is chosen to be slightly less than the distance from the upper edge of lip 30 to locking flange 40, in order to provide a loose clearance between locking flange 40 and lower edge 72 when container 20 is fully assembled, as may be seen in FIG. 5.

Figure 5:
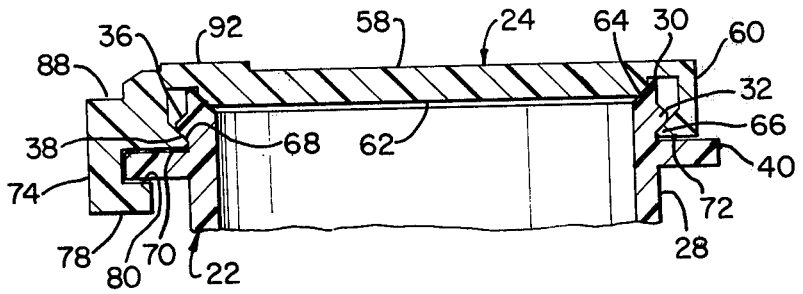
FIG. 5 is a fragmentary sectional view of the closed container taken along the lines 5—5 of FIG. 1.

Referring to FIG. 4, it may be seen that affixed to cap 24 is tab 74 extending downwardly and outwardly from cylindrical side wall 60. Tab 74 subtends circumferentially along skirt 60 a distance slightly less than the circumferential width of opening 42 in locking flange 40. The portion of tab 74 which extends below the level of lower edge 72 of cap 24 is of L-shaped section, with the base of the L facing inwardly. It forms in effect a keyway 76 designed to function as a lock by captivating locking flange 40, when container 20 is closed and cap 24 is properly rotated, as shown in FIG. 5. Keyway 76 is a slot of circular section formed inside tab 74 and having a radius slightly greater than the radius of flange 40. Bottom surface 78 of tab 74 has a substantial radial dimension (e.g. on the order of 5 mm) to provide a thumbhold as well as for structural reasons.

As may be seen in FIG. 6, top surface 86 of tab 74 slopes outwardly and downwardly from top 58 of cap 24 to an edge slightly below the plane of the interior periphery of top 58. By reference to FIGS. 3 and 4, it may be seen that a step, defined by tread 88, is formed in top 86, extending inwardly from the lower edge of top 86 and across the latter from that side 90 of tab 74 which just clears flexible member 50 of safety stop 44 when tab 74 is positioned in opening 42 with container 20 in assembled position. Tread 88 is a typically rectangular planar surface oriented so that its edges are parallel to and normal to a radius of skirt 60 drawn through the center of tab 74. The plane of tread 88 lies parallel to and slightly below that of the interior periphery of top 58. Tread 88 is a mating surface to lower face 52 of catch 46 of safety stop 44 when tab 74 is positioned in opening 42. The dimensions of tread 88 are chosen to be about the same as the corresponding dimensions of lower face 52, while the exact placement of the surface of and the inward most edge of tread 88 is chosen so as to provide adequate clearance between tab 74 and catch 46 when container 20 is in closed condition and either cap 24 is rotated to bring tab 74 into or out of alignment with opening 42 or catch 46 is flexed out of the safety position, as will be described hereinafter.

As may be seen with reference to FIG. 4, fiducial mark 92, in the form of an arrow, is affixed to the exterior of the top 58 of cap 24. Fiducial mark 92 is radially aligned with the center of tab 74. Knurling 94 is provided about the exterior of side wall 60.

Figure 9:
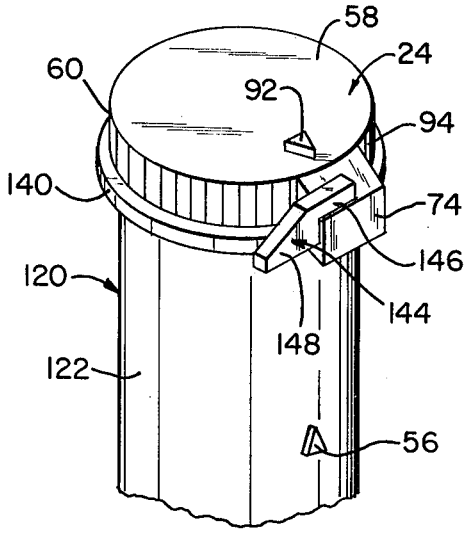
FIG. 9 is a fragmentary view, in perspective, from above, of a closed container made in accordance with the teachings of the present invention, showing an alternative safety means.
Figure 10:
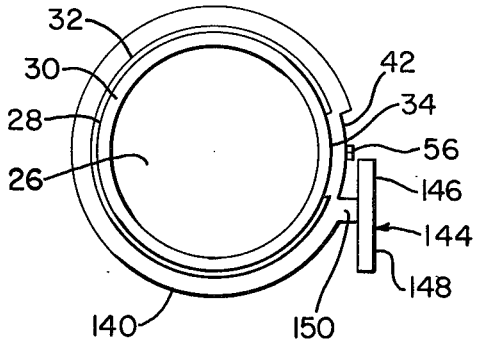
FIG. 10 is a plan view of the top of the opened container of FIG. 9.

In one embodiment of the present invention hereinbefore described, container body 22 is in the form of a jar, and safety stop 44 is affixed to a shoulder of the jar. An alternative design for the safety stop, particularly suited for use with containers in the form of cylindrical vials, is shown in FIGS. 9 and 10, wherein container 120 comprises container body 122 and cap 24. Container body 122 is shown in the form of a cylindrical vial, although it will be understood the overall shape of the container body is not critical. Safety stop 144 is affixed to container body 122 by torsion bar or post 150, as is shown in FIG. 10. Post 150 is, in effect, a short extension (protruding parallel to the plane of rotation of cap 24) of locking flange 140 connecting the side of catch 146 and trigger 148 to container body 122. In all other respects, locking flange 140, catch 146, and trigger 148 are similar to locking flange 40, catch 46, and trigger 48, respectively. The material and cross-section of post 150 are chosen such that a moderate downward force on trigger 148 will place post 150 in torsion, elastically distorting it, and thereby displacing catch 146 away from opening 42 a sufficient distance to permit the opening and closing of the container, as described hereinafter. Other than by its placement and mode of operation, post 150 performs the same function as post 50, and safety stop 144, the same as safety stop 44.

Figure 11:
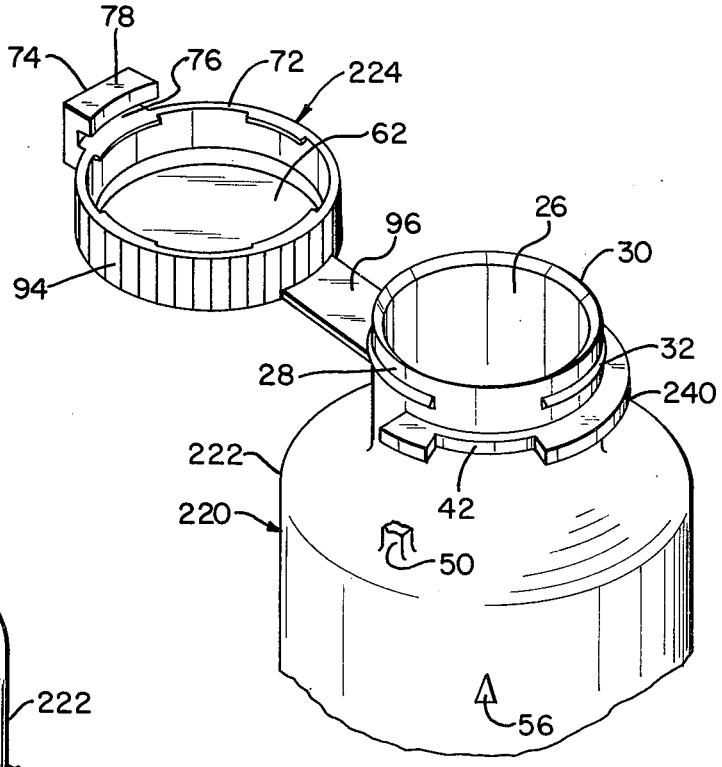
FIG. 11 is a fragmentary perspective view from above and with the safety means broken away, of another opened container embodying the present invention, showing yet a further alternative locking flange and a means for holding the cap capture while in the open condition.
Figure 12:
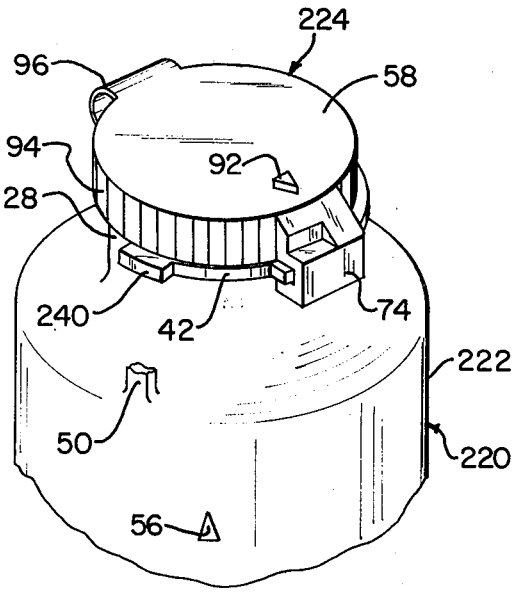
FIG. 12 is a view similar to FIG. 11 showing the container of FIG. 11 in the closed, sealed, and locked condition.

In the embodiments of the present invention heretofore described, the cap can be completely removed and separated from the container body. This may be undesirable, as it allows the cap to be lost. An embodiment of the present invention which addresses this problem is shown in FIGS. 11 and 12, wherein container 220 is shown comprising container body 222 and cap 224. Coupled to cap 224 and connecting it to container body 222 is strap 96, in the form of a thin, flexible sheet. Strap 96 may be manufactured separately or as a part of either cap 224 or container body 222 and then affixed to the other part or parts by any conventional joining method (e.g., cement, heat, or solvent). One end of strap 96 if affixed to the outside of cap 224 diametrically opposite tab 74. In all other respects, cap 224 is similar to cap 24. The other end of strap 96 is connected to container body 222 at or below the plane of latching flange 240. The point of attachment of strap 96 to body 222 is displaced circumferentially from a point diametrically opposite opening 42 (in the direction which brings it closer to post 50 than to the center of opening 42) by an angular distance on the order of a substantial fraction of the angular length of opening 42. The thin dimension and placement of strap 96 are chosen, depending on the material of construction, so as to provide little or no spring tension or resistance against placing or removing cap 224 on or from container 220. In this respect, strap 96 simply acts as a tether. The thick dimension and placement of strap 96 are chosen so as to permit cap 224 (when closed onto container 220) to be rotated with negligible torque about cylindrical section 28 only through a limited angle, at least as great as the angular extent of opening 42. Because strap 96 limits this angle through which cap 224 may be rotated when the container is closed, locking flange 240 need not completely encircle cylindrical section 28, but merely need be provided over a region diametrically opposite the point of attachment of strap 96 to container body 222. In all other respects, locking flange 240 is similar to locking flange 40 and container body 222 is similar to container body 22.

Figure 13:
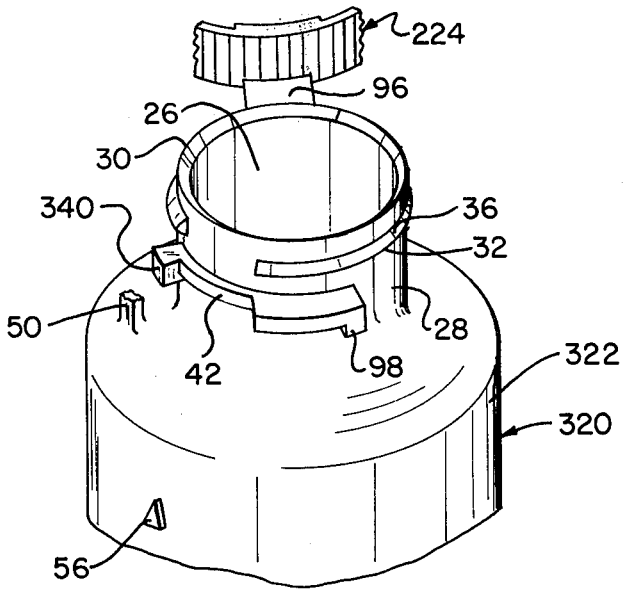
FIG. 13 is a fragmentary view, in perspective, from above, and with the safety means broken away, of an opened container embodying the present invention, showing an alternative locking flange.

Locking flange 240 of container 220 has an angular compass which is determined by strap 96 acting to stop further rotation of cap 224 about cylindrical section 28 of the closed container. Continued forcing of the rotation of cap 224 near this limit may eventually cause strap 96 to break, allowing the cap to rotate until tab 74 is beyond the end of locking flange 240, thereby defeating the operation of the safety features of the present invention. A design which addresses this problem is shown in FIG. 13, where it is seen that container 320 is provided with container body 322 and cap 224. Locking flange 340 on container body 322 is provided with stops 98 in the form of small tabs connected to and depending from the locking flange at respective ends of its compass. In all other respects, locking flange 340 is the same as locking flange 240 and container body 322 is the same as container body 222. In operation, stops 98 limit the amount of rotation which can be imparted on cap 224 (when closed onto container 320) by engagement with the lower sides of tab 74. It will be appreciated that on containers that provide strap 96, the safety feature provided by the latter may obviate use of a safety catch such as 44, inasmuch as double-locking is already provided.

Figure 14:
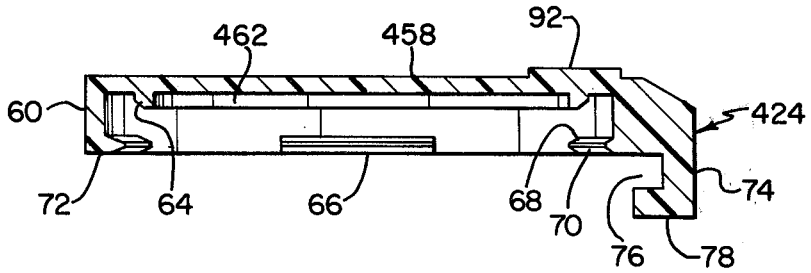
FIG. 14 is a sectional view of a container cap embodying the present invention, taken along the lines 6—6 of FIG. 4 to illustrate an alternative seal.
Figure 15:
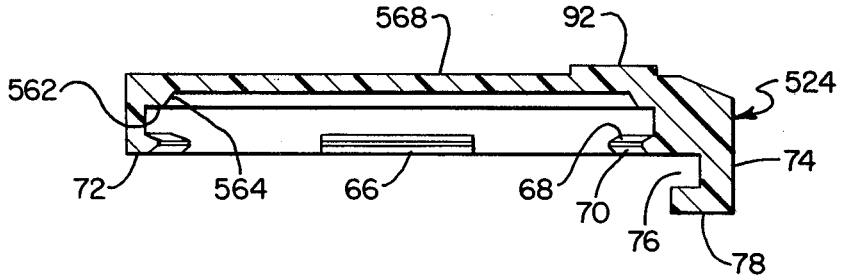
FIG. 15 is a sectional view, similar to FIG. 14, showing yet another seal.

Alternative caps are shown in section in FIGS. 14 and 15. Referring to FIG. 14, there may be seen cap 424 with flat circular top 458. Affixed centrally to the inside of top 458 is ring 462. Ring 462 is slightly smaller in diameter than lip 30 of the corresponding container body 22 (not shown) and the outer edge of the ring is shaped to provide inward bevel 64. In all other respects cap 424 and circular top 458 are similar to cap 24 and top 58.

Because of the narrow support of ring 462 for bevel 64, the latter may be somewhat more deformable under pressure than the comparable bevel in the embodiment of FIGS. 5 and 6, and of course uses less material in its construction.

It should be noted that cap 24 and cap 424 are designed so that container 20 is double sealed by the knife edge of lip 30 being forced into line contact along the interior surface of top 58, and by the bevel of lip 30 being forced into sealing contact with tapered surface 64. This last sealing contact also acts to center top 58 over lip 30.

An alternative seal is provided by the design shown in FIG. 15, where it may be seen that top 568 of cap 524 is provided with a peripheral ledge or ring 562 disposed concentrically within the interior periphery of the top. The interior diameter of ring 562 is chosen to be slightly larger than that of lip 30 of a matching container body (not shown). Outwardly beveled surface 564 extends from the interior surface of top 568 to the inside edge of ring 562. Bevel 564 is substantially smooth and in the form of a truncated cone inclined to the plane of top 568 at an angle on the order of 45°. The height of ring 562 is so chosen that the minimum diameter of bevel 564 is slightly less than that of lip 30. This design permits a seal to be formed by the knife edge of lip 30 centering itself on tapered surface 564. In all other respects, cap 524 and top 568 are similar to cap 24 and top 68.

Inasmuch as containers 120, 220, and 320 and cap 424 and 524 do not differ significantly from container 20 and cap 24 except as hereinabove described in the details of construction assembly, and except as hereinafter noted, the remaining detailed description will be of container 20, it being understood that unless noted, like parts of containers 120, 220, and 320 and of caps 424 and 524 perform similar functions.

In order to close container 20 from an opened condition, such as is illustrated in FIG. 4, cap 24 (which may be loosely coupled to jar 22) is positioned centrally over mouth 26 of container body 22, with the interior of cap 24 facing mouth 26 and with fiducial marks 56 and 92 roughly aligned. In order to lower cap 24 onto neck 28, catch 46 of safety stop 44 must first be displaced to clear tab 74 so that tab 74 may be lowered through opening 42. This displacement may be accomplished in two ways. One may bring edge 90 of tab 74 into contact with catch 46 and rotate cap 24 clockwise (as seen from above). Alternatively, one may apply a downward force with a thumb or finger on upper surface 54 of trigger 48. Either technique distorts or bends post 50 so as to displace catch 46 to a side of opening 42, thereby permitting tab 74 to be lowered past catch 46 into opening 42. Once the lower portion of tab 74 is into opening 42, external force need no longer be applied to safety stop 44, as the restrictions placed on tab 74 by opening 42 will be sufficient to resist the torque applied to side wall 90 of tab 74 by the flexible restoring forces of post 50.

As cap 24 is further lowered, lower surface 70 of flange 66 contacts upper surface 36 of catch flange 32. Force applied downwardly to top 58 of cap 24, acting through the contacting bevels of lower surface 70 and upper surface 36, elastically distorts cap 24, distorting or bulging skirt 60 outwardly and allowing latch flange 66 to ride over catch flange 32. Once latch flange 66 has overridden catch flange 32, the elastic restoring forces inherent in cap 24 act to force upper surface 68 of latch flange 66 under lower surface 38 of catch flange 32, making cap 24 captive to container body 22 in the closed position, and simultaneously wedging cap 24 down onto container body 22, resiliently forcing the knife-edge of lip 30 into tight sealing contact with the interior surface of top 58 and edge 64. As cap 24 thus wedges itself downwardly on container body 22, catch 46 overrides edge 90, and the elastic restoring force of post 50 snaps catch 46 into place above tread 88 on tab 74, thereby automatically engaging safety stop 44. In this closed and sealed condition of locking flange 40 is therefore aligned with keyway 76. A counter-clockwise rotation, as seen from above, of cap 24 relative to container body 22 engages locking flange 40 and keyway 76, effecting the locked condition of the container. Container 20 is now as pictured in FIG. 1.

Figure 2:
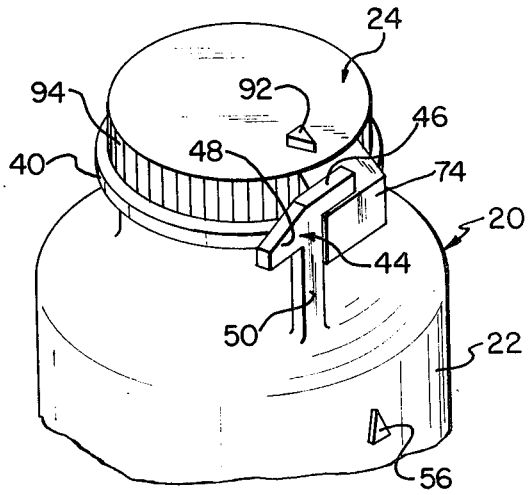
FIG. 2 is a fragmentary view, in perspective, of the container of FIG. 1, fully closed, sealed and unlocked, but showing the safety means engaged.
Figure 3:
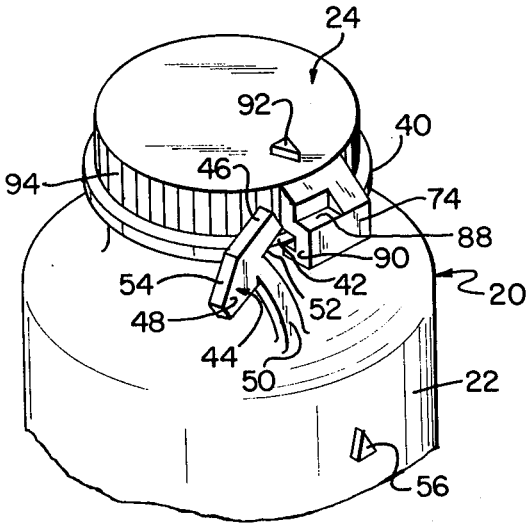
FIG. 3 is a view as in FIG. 2, showing the safety means disengaged.

Container 20 is designed so that, once closed, it may be secured in a closed condition by more than one means. The first of these means, operative at all times the container is closed, is provided by the contact of upper surface 68 of latch flange 66 with lower surface 38 of catch flange 32, which prevents an upward motion of cap 24 relative to container body 22. This first means for securing the container in a closed condition is designed to be overcome by the user forceably displacing tab 74 upward thereby producing an elastic deformation of cap 24, flexing cylindrical skirt 60 outwardly. The flexure of skirt 60 permits latch flange 66 to disengage and clear catch flange 32, allowing cap 24 to be removed from container body 22. A second means for securing the container closed is, in effect, a lock which is operative in all positions of cap 24 of the closed container relative container body 22 except for the unique unlocking position where tab 74 is centered in opening 40. In all other positions, the closed container is locked as illustrated in FIGS. 1 and 5, because keyway 76 has captured locking flange 40. In this locked condition, upward motion of tab 74 is ineffective in removing the cap because of the continued engagement of surface 80 of the tab with locking flange 40. By rotating cap 24 in a clockwise direction, as seen from above, relative to container body 22 until keyway 76 rides off locking flange 40 when tab 74 becomes centered in opening 42, one can unlock the cap. Fiducial marks 56 and 92, when aligned, indicate this unlocked position of cap 24 relative to container body 22. However, as may be seen in FIG. 2, even when the Fiducial marks are aligned or registered, catch 46 of safety stop 44 is above tab 74, and any upward motion of the tab will still be arrested by tread 88 of tab 74 contacting lower face 52 of catch 46. Stop 44 thus constitutes another safety means designed to be disengaged by applying a downward force on upper surface 54 of trigger portion 48, thereby elastically distorting post 50 to move catch 46 clear of tab 74, as shown in FIG. 3.

From the foregoing, it should be understood that container 20 is designed so that, once locked closed, it can be opened only by a specific sequence of operations, instructions for which can be provided the user by, for instance, a printed label attached to the container.

The sealing of container 20 against moisture and other atmospheric contaminants is accomplished, as hereabove described, by the elastic restoring forces of cap 24 acting through upper surface 68 of latch flange 66 and lower surface 38 of catch flange 32 to force lip 30 into tight sealing contact with the interior surface of top 58. To insure this seal, it should be noted that upper surface 68 must be disposed somewhat nearer to the interior surface of top 58 than lower surface 38 is to lip 30. Thus, when the container is fully closed, latch flange 66 has not completely overridden catch flange 32 to the extent necessary to permit cap 24 to return to an elastically relaxed condition. Lip 30 is thus resiliently driven into and held against the interior of top 58 under tension produced by the elastic restoring forces of cap 24 acting through the opposed wedges formed by upper surface 68 and lower surface 38. It should further be noticed that the closing and sealing force driving lip 30 into the interior surface of top 58 may be made larger than the inward directed force produced by the relaxation of the elastically deformed cap 24, by providing that upper surface 68 and lower surface 38 are inclined at a substantially shallow angle to the planes of top 58 and lip 30, respectively, thereby obtaining a desirable mechanical advantage.

Since certain changes may be made in the above apparatus without departing from the scope of the invention herein involved, it is intended that all matter contained in the above description or shown in the accompanying drawing shall be interpreted in an illustrative and not in a limiting sense.

What is claimed is:

1. In combination with a container having a neck terminating in a mouth of substantially circular cross-section; a cylindrical cap having an end closure and being mountable for rotation about said mouth; mating first, second and third flanges, all being at least partial annulae, disposed respectively about said neck proximate said mouth, the inner circumference of said cap, and about said neck distal said mouth so that when said flanges are mated said second flange lies between said first and third flanges for capturing said cap in closing relation to said mouth, said third flange having a circumferential discontinuity therein; and a tab mounted on and extending radially from said cap so as to be engageable for levering said cap from said neck when said flanges are mated and said cap and neck are in an unlocking position wherein said tab and discontinuity are registered with one another; the improvement comprising a keyway slot disposed in said tab for engaging said third flange upon rotation of said cap about said neck from said unlocking position when said flanges are mated.

2. The combination as defined in claim 1 wherein said cap is formed of an elastically deformable material and said first flange includes an annular frustoconical upper surface so shaped that said flanges can be mated by driving said cap into said mouth with sufficient force to cause such engagement of said second flange with said upper surface as to deform said cap sufficiently to permit said second flange to slip past said first flange.

3. The combination as defined in claim 2 wherein said first flange includes a frustoconical lower surface opposed to said upper surface, said second flange includes a frustoconical surface so angled and spaced from said end closure relative to the spacing between said mouth and said lower surface that when said flanges are mated said frustoconical surface of said second flange is in engagement with said lower surface of said first flange with force provided by the elasticity of said cap sufficient to force said closure into sealing relation to said mouth.

4. The combination as defined in claim 3 wherein said mouth includes an inner frustoconical surface directly toward an apex located in said container, so as to provide said mouth with a lip having substantially a knife-edge.

5. The combination as defined in claim 1 including a flexible coupling between the external surfaces of said cap and said container.

6. The combination as defined in claim 5 wherein said coupling comprises an elongated strap positioned and dimensioned for permitting said cap and container to be separated or coupled with minimal elastic resistance, and for limiting the rotation of said cap when said flanges are mated.

7. The combination as defined in claim 6 wherein said strap is mounted so that its axis of elongation extends radially at a position circumferentially displaced from said discontinuity.

8. The combination as defined in claim 1 including a detent, means resiliently mounting said detent on said container for movement between a locking position wherein when said flanges are mated said detent is normally biased so as to overlie and contact said tab to prevent upward motion thereof toward said mouth, and an unlocking position wherein said detent is to one side of the path of said upward motion.

9. The combination as defined in claim 8 wherein said means resiliently mounting said detent comprises a cantilever beam extending substantially normally to the plane of rotation of said cap, a portion of said detent being manually engageable for flexing said beam to move said detent out of said locking position.

10. The combination as defined in claim 8 wherein said means resiliently mounting said detent comprises a torsion bar extending substantially parallel to the plane of rotation of said cap, a portion of said detent being manually engageable for flexing said bar to move said detent of said locking position.

* * * * *